US005656095A

United States Patent [19]

Honda et al.

[11] Patent Number: 5,656,095

[45] Date of Patent: Aug. 12, 1997

[54] ULTRASONIC WASHING METHOD AND APPARATUS USING CONTINUOUS HIGH FREQUENCY ULTRASONIC WAVES AND INTERMITTENT LOW FREQUENCY ULTRASONIC WAVES

[75] Inventors: Keisuke Honda; Toshiaki Miyamoto; Hideo Kouzaka, all of Aichi-ken, Japan

[73] Assignee: Honda Electronic Co., Ltd., Toyohashi, Japan

[21] Appl. No.: 330,009

[22] Filed: Oct. 27, 1994

[30] Foreign Application Priority Data

Oct. 28, 1993 [JP] Japan ..... 5-292734

[51] Int. Cl.[6] ..... B08B 3/12

[52] U.S. Cl. ..... 134/1; 134/184

[58] Field of Search ..... 134/1, 184; 366/127

[56] References Cited

U.S. PATENT DOCUMENTS

| | | | |
|---|---|---|---|
| 4,409,999 | 10/1983 | Pedziwiatr | 134/184 |
| 4,672,984 | 6/1987 | Ohhashi | 134/184 X |
| 4,826,538 | 5/1989 | Sanders et al. | 134/1 |
| 4,893,320 | 1/1990 | Yanagi et al. | 134/184 X |
| 5,039,347 | 8/1991 | Hindstrom et al. | 134/1 |
| 5,076,854 | 12/1991 | Honda et al. | 134/1 |
| 5,137,580 | 8/1992 | Honda | 134/1 |
| 5,218,980 | 6/1993 | Evans | 134/184 X |

*Primary Examiner*—Jill Warden
*Assistant Examiner*—Saeed Chaudhry
*Attorney, Agent, or Firm*—Burgess, Ryan & Wayne

[57] ABSTRACT

A plurality of small bubbles are continuously generated by transmitting to washing water in a vessel, a high frequency ultrasonic wave from an ultrasonic vibrator which generates a high frequency output from a high frequency oscillator and intermittently transmitted low frequency ultrasonic waves from ultrasonic vibrators wherein the intermittent low frequency ultrasonic waves are produced from low frequency outputs from low frequency oscillators for short periods of time. The plurality of small bubbles are destroyed by the intermittent ultrasonic waves and the pressure from the sound of the ultrasonic waves in the washing water is thereby increased and washing performance is improved.

3 Claims, 4 Drawing Sheets

ULTRASONIC WASHING METHOD AND APPARATUS USING CONTINUOUS HIGH FREQUENCY ULTRASONIC WAVES AND INTERMITTENT LOW FREQUENCY ULTRASONIC WAVES

FIELD OF THE INVENTION

The present invention relates to an ultrasonic washing method and apparatus employing ultrasonic waves of high and low frequency.

BACKGROUND OF THE INVENTION

Ultrasonic washing methods are known in which one ultrasonic vibrator is connected to one oscillator which produces an ultrasonic wave of a first frequency in a short time which is transmitted to washing water contained in a washing vessel. The ultrasonic vibrator is then switched to another oscillator and the ultrasonic wave produced of a second frequency is transmitted to the washing water in the next short time (see Japanese Patent Application No. 312620/88).

In this ultrasonic washing method, a plurality of air bubbles are generated in the washing water by the ultrasonic wave of the first frequency. Before these bubbles disappear, the ultrasonic wave of the second frequency is transmitted within a short time, and the remaining bubbles are destroyed by the ultrasonic wave of the second frequency. Also, the bubbles generated by the ultrasonic wave of the second frequency are destroyed by the next ultrasonic wave of the first frequency. Accordingly, the pressure of the ultrasonic wave for washing is increased because the pressure of the sound generated by the destruction of the bubbles is added to that of the ultrasonic waves of the first and second frequencies.

In the ultrasonic washing method, even if the ultrasonic wave of the second frequency is transmitted to the washing water before the bubbles generated by the ultrasonic wave of the first frequency disappear, the addition of the sound is not effective, because the greater part of the bubbles generated by the ultrasonic wave of the first frequency disappear.

SUMMARY OF THE INVENTION

It is, therefore, the primary object of the present invention to provide an ultrasonic washing method and apparatus for improving washing by transmitting ultrasonic waves of high frequencies and a burst of an ultrasonic wave of lower frequency.

It is another object of the present invention to provide an ultrasonic washing method and apparatus for improving washing by transmitting ultrasonic waves of multiple frequencies when bubbles generated by ultrasonic waves are destroyed by a burst of an ultrasonic wave of lower frequency.

In order to accomplish the above and other objects, the present invention comprises generating small bubbles of from about 20μ–500μ by transmitting to the washing water contained in a vessel, a high frequency ultrasonic wave from a first ultrasonic vibrator adopted to generate said high frequency ultrasonic wave by a high frequency output from a high frequency oscillator, intermittently transmitting to the washing water ultrasonic waves from at least one second ultrasonic vibrator adapted to generate by low frequency outputs from at least one low frequency oscillator wherein the low frequency output is transmitted for a short period of time, whereby ultrasonic waves of multiple frequencies are transmitted to the washing water.

DESCRIPTION OF THE PREFERRED EMBODIMENTS

Figure 1:
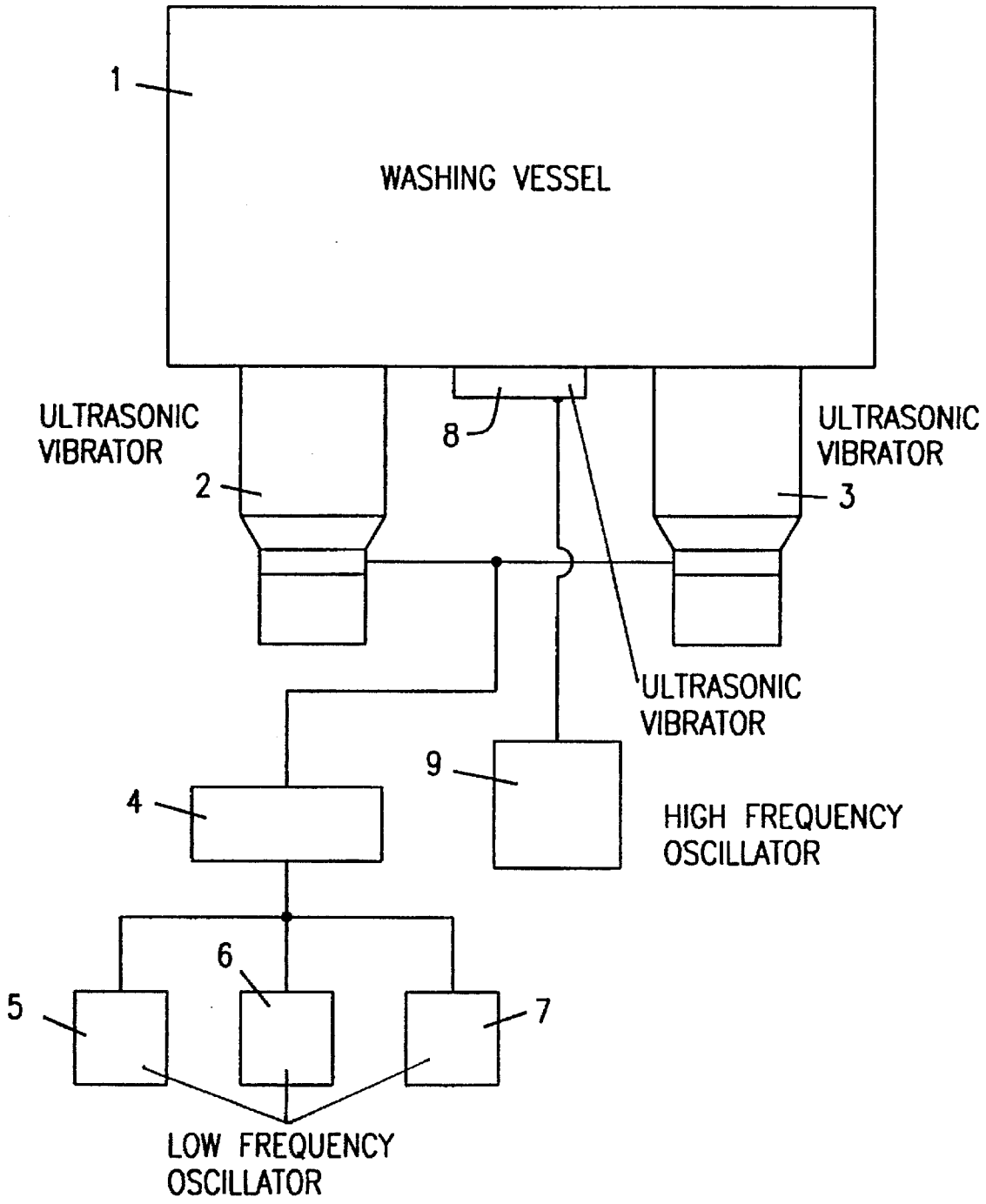
FIG. 1 shows a schematic view of an ultrasonic washing apparatus of one embodiment according to the present invention.

Referring to FIG. 1, ultrasonic vibrators 2 and 3 of a langevin type are attached to a base of a washing vessel 1 containing solid material to be acted upon. Low frequency oscillators 5, 6, and 7 are connected through a switching device 4 to the ultrasonic vibrators 2 and 3. A high frequency ultrasonic vibrator 8 is attached to the base of the washing vessel 1 and a high frequency oscillator 9 is connected to the ultrasonic vibrator 8. Then, the outputs of the low frequencies from the low frequency oscillators 5, 6 and 7 are intermittently applied to the ultrasonic vibrators 2 and 3 and the high frequency output from the oscillator 9 is continuously applied to the ultrasonic vibrator 8.

In the ultrasonic washing apparatus of the embodiment of FIG. 1, small bubbles are continuously generated and fill the washing vessel 1 by the output of the high frequency waves from the ultrasonic vibrator 8. When the outputs from the low frequency oscillators 5, 6, and 7 are intermittently transmitted at short intervals by the switching device 4 and are applied to the ultrasonic vibrators 2 and 3, the low frequency ultrasonic waves are transmitted to the washing vessel 1. The bubbles filling the washing vessel 1 are destroyed by the low frequency ultrasonic waves. Accordingly, because of the pressure of sound generated by destroying the continuously generating bubbles is added to the high and low frequency ultrasonic waves, the pressure of the sound for washing is increased and the washing effect is improved. Also, because the bubbles which are generated by the low frequency ultrasonic waves are destroyed by the high and low frequency ultrasonic waves, the pressure of the sound generated by destroying these bubbles is added to the pressure of the sound arising from the destruction of the bubbles and the pressure of the high and low frequency ultrasonic waves and the pressure of the sound for washing is greatly increased.

Figure 2:
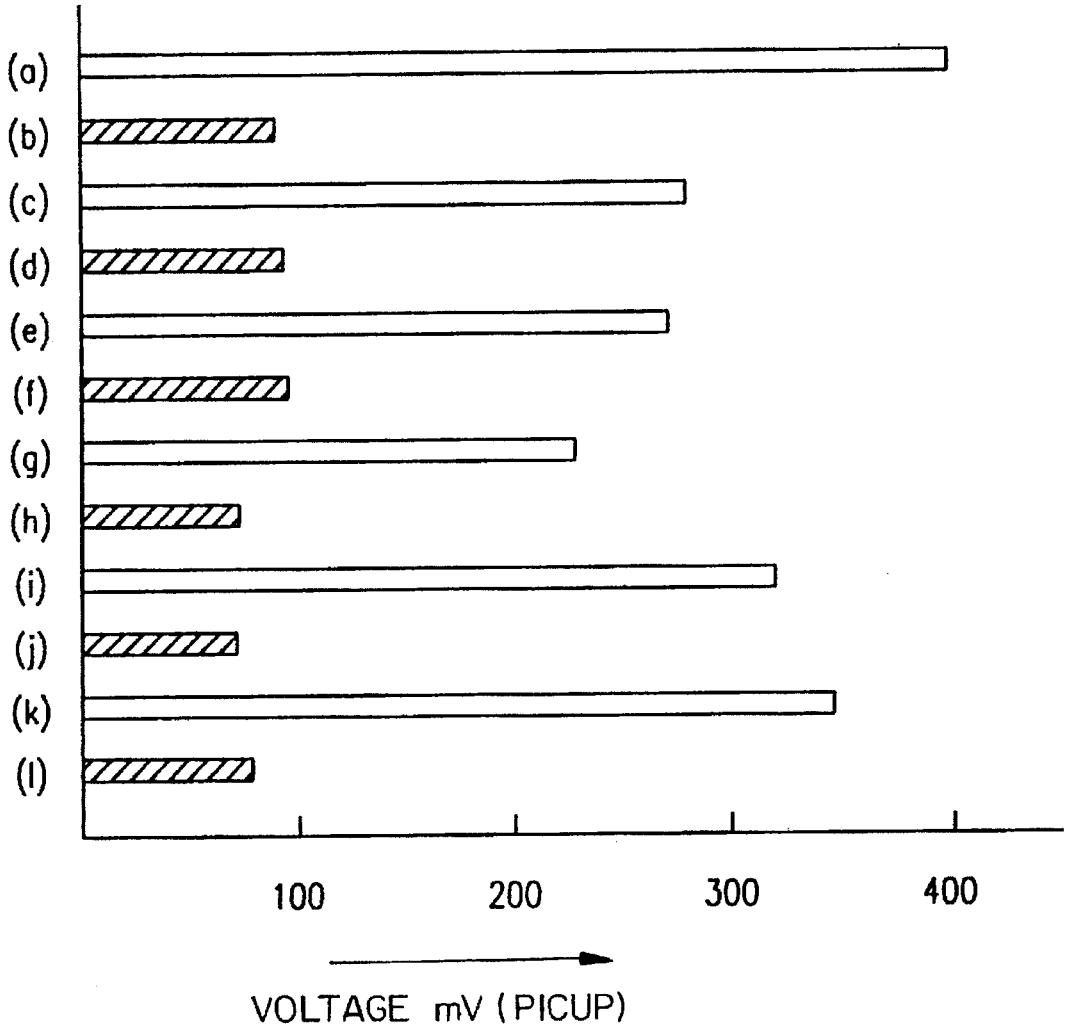
FIGS. 2(*a*)–2(*l*) show graphs explaining the washing effect obtained by the apparatus of FIG. 1 using different frequency signals.

An experimental example in which the pressure of the sound is greatly increased is shown in FIG. 2. The ultrasonic wave from the ultrasonic vibrator 8 generated with 160 KHz from the high frequency oscillator 9 is continuously transmitted to the washing water in the washing vessel 1. The ultrasonic waves from the ultrasonic vibrators 2 and 3 generated with 28 KHz from the low frequency oscillator 5 and 45 KHz from the low frequency oscillator 6 are intermittently applied to the washing water of the vessel 1 by the switching device 4 every 10 ms, and the pressure of the ultrasonic wave measured by a pickup voltage in the vessel 1 is about 400 mV or more as shown in FIG. 2(*a*).

On the contrary, as shown in FIG. 2(*b*), when the ultrasonic waves from the ultrasonic vibrators 2 and 3 generated with 28 KHz from the low frequency oscillator 5 and 45 KHz from the low frequency oscillator 6 are applied to the vessel 1 by the switching device 4 every 5 ms, the pressure of the ultrasonic wave measured by the pickup voltage in the vessel 1 is about 100 mV.

As shown in FIG. 2(*c*), when the ultrasonic wave from the ultrasonic vibrator 8 generated with 160 KHz from the high frequency oscillator 9 is continuously transmitted to the washing water in the washing vessel 1 and the ultrasonic waves from the ultrasonic vibrators 2 and 3 generated with 28 KHz from the low frequency oscillator 5 and 45 KHz from the lwo frequency oscillator 6 are applied to the washing water of the vessel 1 by the switching device 4 every 5 ms, the pressure of the ultrasonic wave measured by the pickup voltage in the vessel 1 is about 250 mV or more.

As shown in FIG. 2(*d*), when the ultrasonic waves from the ultrasonic vibrators 2 and 3 generated with 28 KHz from the low frequency oscillator 5 and 45 KHz from the low frequency oscillator 6 are applied to washing water of vessel 1 by the switching device 4 every 5 ms, the pressure of the ultrasonic wave measured by the pickup voltage in the vessel 1 is about 100 mV and is the same as that in FIG. 2(*b*).

As shown in FIG. 2(*e*), when the ultrasonic wave from the ultrasonic vibrator 8 generated with 160 KHz from the high frequency oscillator 9 is continuously transmitted to the washing water in the washing vessel 1 and the ultrasonic wave from the ultrasonic vibrators 2 and 3 generated with 28 KHz from the low frequency oscillator 5 and 45 KHz from the low frequency oscillator 6 are applied to the washing water of the vessel 1 by the switching device 4 every 3 ms, the pressure of the ultrasonic wave measured by the pickup voltage in the vessel 1 is about 250 mV or more.

As shown in FIG. 2(*f*), when the ultrasonic waves from the ultrasonic vibrators 2 and 3 generated by 28 KHz from the low frequency oscillator 5 and 45 KHz from the low frequency oscillator 6 by the switching device 4 every 3 ms are transmitted to the vessel 1, the pressure of the ultrasonic wave measured by the pickup voltage in the vessel 1 is about 100 mV.

As shown in FIG. 2(*g*), when the ultrasonic wave from the ultrasonic vibrator 8 generated by 160 KHz from the high frequency oscillator 9 is continuously transmitted to the washing water in the washing vessel 1 and the ultrasonic waves from the ultrasonic vibrators 2 and 3 of 28 KHz from the low frequency oscillator 5, 45 KHz from the low frequency oscillator 6 and 100 KHz from the low frequency oscillator 7 are applied to the washing water of the vessel 1 by the switching device 4 every 10 ms, the pressure of the ultrasonic wave measured by the pickup voltage in the vessel 1 is about 220 mV or more.

On the contrary, as shown in FIG. 2(*h*), when the ultrasonic waves from the ultrasonic vibrators 2 and 3 generated by 28 KHz from the low frequency oscillator 5 and 45 KHz from the low frequency oscillator 6 by the switching device 4 every 10 ms are transmitted to the vessel 1, the pressure of the ultrasonic wave measured by the pickup voltage in the vessel 1 is about 100 mV.

As shown in FIG. 2(*i*), when the ultrasonic wave from the ultrasonic vibrator 8 generated by 160 KHz from the high frequency oscillator 9 is continuously transmitted to the washing water in the washing vessel 1 and the ultrasonic waves from the ultrasonic vibrators 2 and 3 of 28 KHz from the low frequency oscillator 5, 45 KHz from the low frequency oscillator 6 and 100 KHz from the low frequency oscillator 7 are applied to the washing water of the vessel 1 by the switching device 4 every 5 ms. the pressure of the ultrasonic wave measured by the pickup voltage in the vessel 1 is about 320 mV or more.

On the contrary, as shown in FIG. 2(*j*), when the ultrasonic waves from the ultrasonic vibrators 2 and 3 generated by 28 KHz from the low frequency oscillator 5 and 45 KHz from the low frequency oscillator 6 by the switching device 4 every 5 ms are transmitted to the vessel 1, the pressure of the ultrasonic wave measured by the pickup voltage in the vessel 1 is about 100 mV.

As shown in FIG. 2(*k*), when the ultrasonic wave from the ultrasonic vibrator 8 generated by 160 KHz from the high frequency oscillator 9 is continuously transmitted to the washing water in the washing vessel 1 and the ultrasonic waves from the ultrasonic vibrators 2 and 3 of 28 KHz from the low frequency oscillator 5, 45 KHz from the low frequency oscillator 6 and 100 KHz from the low frequency oscillator 7 are applied to the washing water of the vessel 1 by the switching device 4 every 3 ms, the pressure of the ultrasonic wave measured by the pickup voltage in the vessel 1 is about 350 mV or more.

On the contrary, as shown in FIG. 2(*l*), when the ultrasonic waves from the ultrasonic vibrators 2 and 3 generated by 28 KHz from the low frequency oscillator 5 and 45 KHz from the low frequency oscillator 6 by the switching device 4 every 5 ms are transmitted to the vessel 1, the pressure of the ultrasonic wave measured by the pickup voltage in the vessel 1 is about 100 mV.

Figure 3:
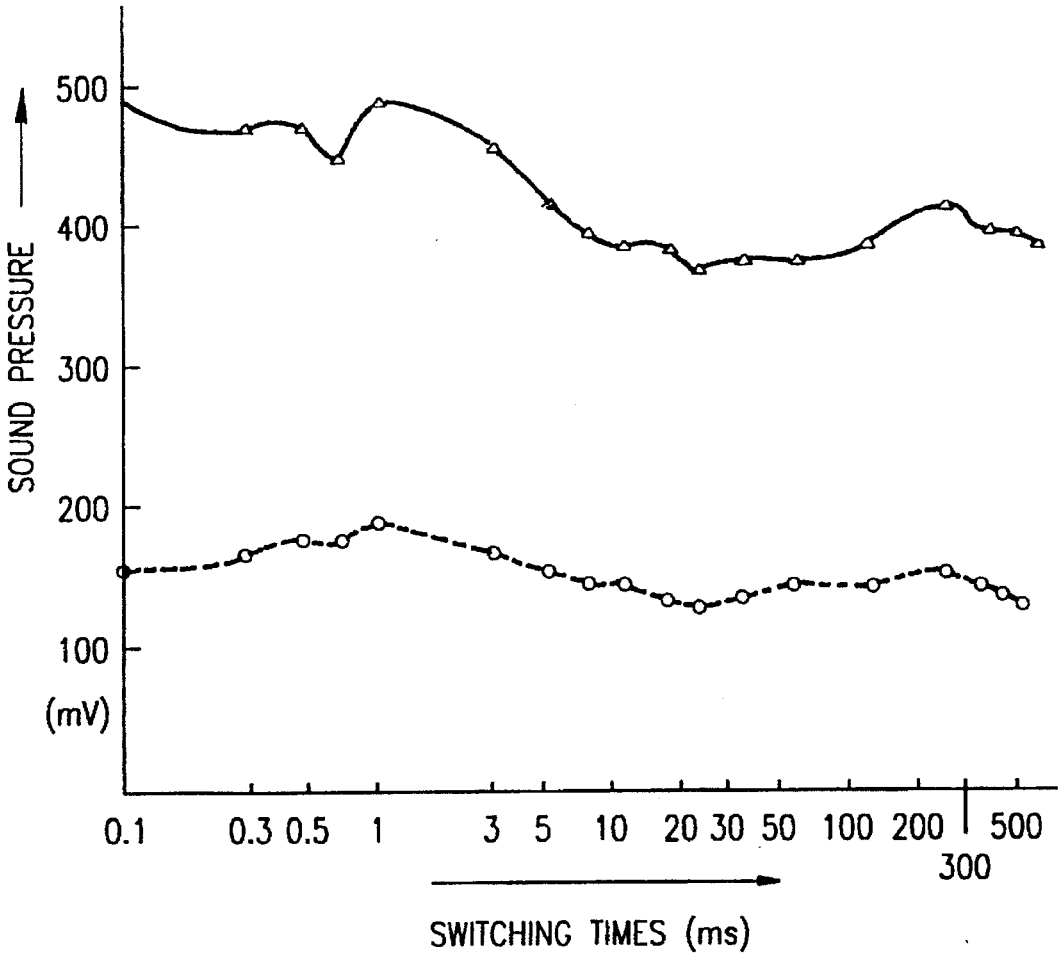
FIG. 3 shows a graph explaining the washing effect obtained by the apparatus of FIG. 1.

In FIG. 3, the dotted line shows pressures of sound of the ultrasonic waves from the ultrasonic vibrators 2 and 3 in vessel 1 which are generated by the low frequency outputs of 28 KHz and 45 KHz from the low frequency oscillators 5 and 6 by switching from about 0.1 ms to 500 ms. The solid line shows pressures of sound of the ultrasonic waves from the ultrasonic vibrator 8 generated by the high frequency output of 100 KHz from the high frequency oscillator 9 continuously transmitted to the washing water in the vessel 1 and the ultrasonic waves from the ultrasonic vibrators 2 and 3 which are generated by the low frequency outputs of 28 KHz and 45 KHz from the low frequency oscillators 5 and 6 by switching from about 0.1 ms to 500 ms are intermittently transmitting to the washing water in the vessel 1.

As shown in FIG. 3, the pressure of the sound of the ultrasonic wave from only low frequencies is about 180 mv. When the ultrasonic waves of the low frequencies are added to the ultrasonic wave of the high frequency, the pressure of the sound becomes 400 mV or more and the washing effect is improved.

Figure 4:
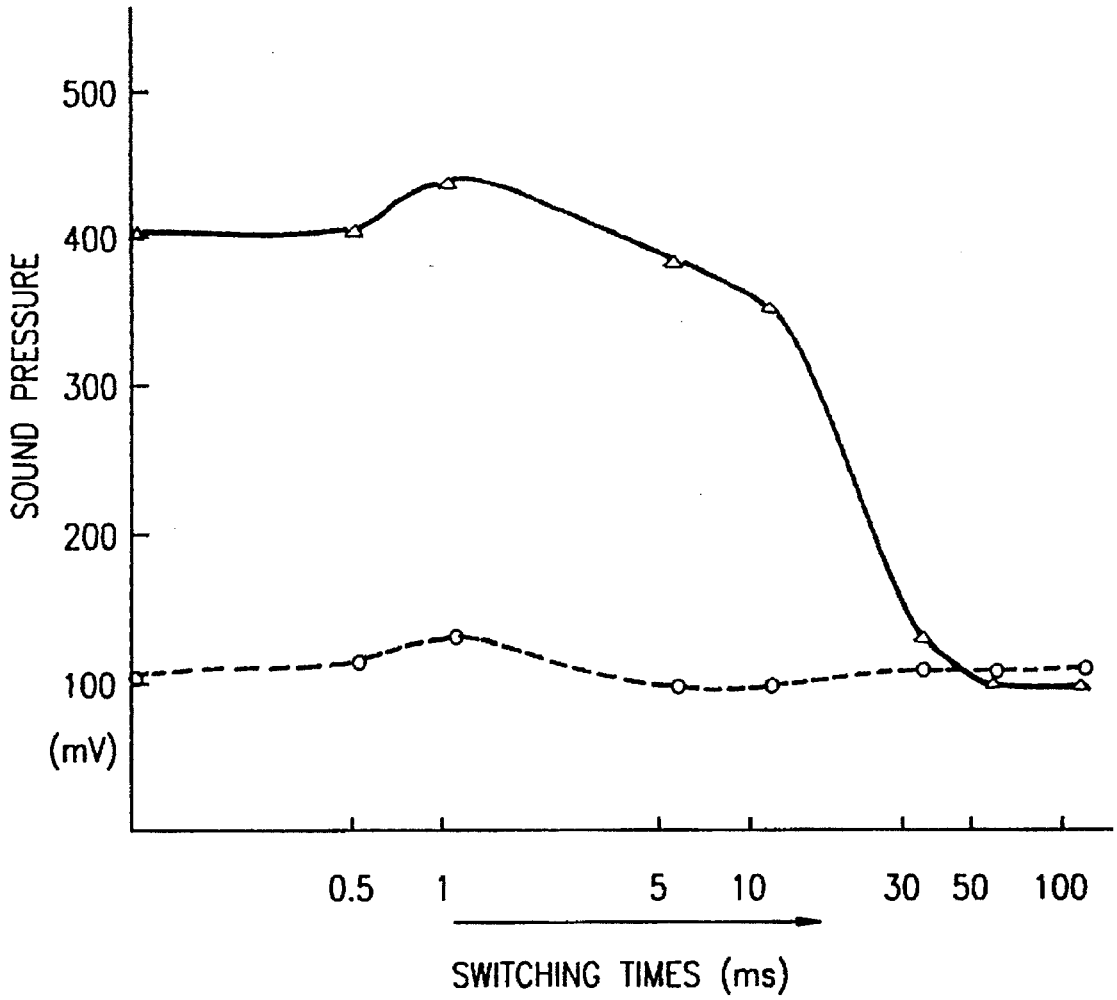
FIG. 4 shows a graph explaining the washing effect obtained by the apparatus of FIG. 1.

In FIG. 4, the dotted line shows pressures of sound of the ultrasonic waves from the ultrasonic vibrators 2 and 3 in vessel 1 which are generated by the low frequency outputs of 28 KHz, 45 KHz and 100 KHz from the low frequency oscillators 5, 6 and 7 by switching from about 0.1 ms to 100 ms. A solid line shows pressures of sound of the ultrasonic waves in which the ultrasonic wave from the ultrasonic vibrator 8 generated by the high frequency output of 160 KHz from the high frequency oscillator 9 continuously transmitted to the washing water in the vessel 1 and the ultrasonic waves from the ultrasonic vibrators 2 and 3 which are generated by the low frequency outputs of 28 KHz, 45 KHz and 100 KHz from the low frequency oscillators 5, 6 and 7 by switching from about 0.1 ms to 100 ms are intermittently transmitted to the washing water in the vessel 1.

In FIG. 4, the output represented by the solid line is higher than that of the dotted line for the switching intervals from about 0.1 ms to 10 ms. But, the output of the solid line gradually becomes lower than that of the solid line for switching times of 10 ms or more and the output of the dotted line becomes higher than that of the solid line at 40 ms.

In the above experimental examples, the low frequencies used were 28 KHz, 45 KHz and 100 KHz and the high frequency used was 160 KHz, but other frequencies can be used for the low frequency and the high frequency.

As stated above, in the washing apparatus according to the present invention, when bubbles having a size of from about 20μ to 500μ are formed in the washing water in the vessel by transmitting the high frequency ultrasonic wave and the intermittent low frequency ultrasonic waves are transmitted by the bubbles in the washing water in the vessel, the ultrasonic waves of high orders are generated by destroying the bubbles. Accordingly, the washing effect is greatly improved.

What is claimed is:

1. An ultrasonic washing method for acting on solid material placed in washing water contained within a vessel, comprising the steps of:

placing an object in washing water contained within a vessel generating bubbles in said washing water in the range from about 20μ to 500μ by:

generating a first continuous ultrasonic signal having a first ultrasonic frequency of at least 100 KHz by a first ultrasonic oscillator, and transmitting a first continuous ultrasonic wave to the washing water contained within the vessel by a first ultrasonic vibrator in response to said first continuous ultrasonic signal, and destroying said bubbles in the range from about 20μ to 500μ by:

generating second intermittent ultrasonic signals by at least one second ultrasonic oscillator such that each second ultrasonic signal has a second ultrasonic frequency in the range of 20 KHz to 100 KHz, and transmitting second intermittent ultrasonic waves to said washing water by a switching device from at least one second ultrasonic vibrator in response to said second ultrasonic signals.

2. An ultrasonic washing apparatus for acting on solid material placed in washing water contained within a vessel, comprising:

first ultrasonic oscillator means for generating a first continuous ultrasonic signal having a first ultrasonic frequency of at least 100 KHz, first ultrasonic vibrator means attached to the vessel containing washing water for transmitting a first continuous ultrasonic wave to the washing water contained within the vessel in response to the first continuous ultrasonic signal from said first ultrasonic oscillator means, at least one second ultrasonic oscillator means for generating second intermittent ultrasonic signals such that each second ultrasonic signal has a second ultrasonic frequency which is less than said first ultrasonic frequency, at least one second ultrasonic vibrator means attached to said vessel for intermittently transmitting second intermittent ultrasonic waves to said washing water in response to the second intermittent ultrasonic signals from said at least one second ultrasonic oscillator means, and a switching device for intermittently transmitting the second intermittent ultrasonic signals to said at least one second ultrasonic vibrator means every 5 ms such that bubbles generated by said first continuous ultrasonic wave are destroyed by said second intermittent ultrasonic waves.

3. The ultrasonic washing apparatus of claim 2 wherein each said second ultrasonic frequency is in the range from about 20 KHz to 100 KHz.

* * * * *